US005121141A

United States Patent [19]

Hadimoglu et al.

[11] Patent Number: 5,121,141

[45] Date of Patent: Jun. 9, 1992

[54] ACOUSTIC INK PRINTHEAD WITH INTEGRATED LIQUID LEVEL CONTROL LAYER

[75] Inventors: Babur B. Hadimoglu, Mountain View; Butrus T. Khuri Yakub, Palo Alto, both of Calif.

[73] Assignee: Xerox Corporation, Stamford, Conn.

[21] Appl. No.: 640,679

[22] Filed: Jan. 14, 1991

[51] Int. Cl.[5] ..... B41J 2/045

[52] U.S. Cl. ..... 346/140 R; 310/335

[58] Field of Search ..... 346/140 R, 1.1; 29/890.1, 464; 156/91, 92; 310/335

[56] References Cited

U.S. PATENT DOCUMENTS 4,454,519 6/1984 Oosaka et al. ..... 346/140 R
4,751,530 6/1988 Elrod et al. ..... 346/140 R
4,801,953 1/1989 Quate ..... 346/140 R
4,959,674 9/1990 Khri-Yakub et al. ..... 346/140 R

*Primary Examiner*—Benjamin R. Fuller
*Assistant Examiner*—Victor DeVito
*Attorney, Agent, or Firm*—Townsend and Townsend

[57] ABSTRACT

An acoustic ink printhead with an integrated liquid level control layer is presented. A spacer layer is fixed to a substrate. Apertures are created in the spacer layer, which is then used as a mask, to define acoustic lenses and ink supply channels in the substrate. The apertures in the spacer layer used to define self-aligned acoustic lenses and to form the cavities to hold the ink reservoirs for each ejector. The thickness of the spacer layer is set so that acoustic waves from the acoustic lens below are focused at the free surface of the ink which maintains its level at the top of the spacer layer by capillary action.

11 Claims, 3 Drawing Sheets

ACOUSTIC INK PRINTHEAD WITH INTEGRATED LIQUID LEVEL CONTROL LAYER

BACKGROUND OF THE INVENTION

This invention relates to acoustic ink printing and, specifically, to an improved acoustic ink printhead with an integrated liquid level control layer and method of manufacture therefor.

In acoustic ink printing, acoustic radiation by an ejector is used to eject individual droplets on demand from a free ink surface. Typically several ejectors are arranged in a linear or two-dimensional array in a printhead. The ejectors eject droplets at a sufficient velocity in a pattern so that the ink droplets are deposited on a nearby recording medium in the shape of an image.

A droplet ejector employing a concave acoustic focusing lenses is described in U.S. Pat. No. 4,751,529, issued on Jan. 14, 1988 to S.A. Elrod et al., and assigned to the present assignee. These acoustic ink ejectors are sensitive to variations of their free ink surface levels. The size and velocity of the ink droplets which are ejected are difficult to control unless the free ink surfaces remain within the effective depth focus of their droplet ejectors. Thus the free ink surface level of such a printer should be closely controlled.

To maintain the free ink surfaces at more or less constant levels, various approaches have been proposed for acoustic ink printers One approach is the use of a closed loop servo system for increasing and decreasing the level of the free-ink surface under the control of an error signal which is produced by comparing the output voltage levels from the upper and lower halves of a split photo-detector. The magnitude and sense of that error signal are correlated with the free ink surface level by the reflection of a laser beam off the free ink surface to symmetrically or asymmetrically illuminate the opposed halves of the photodetector depending upon whether the free ink surface is at a pre-determined level or not. This approach is somewhat costly to implement and requires that provision be made for maintaining the laser and the split photo-detector in precise optical alignment. Moreover, it is not well-suited for use with larger ejector arrays because the surface tension of the ink tends to cause the level of the free surface to vary materially when the free surface spans a large area.

Another approach is described in U.S. Pat. No. 5,028,937, issued on Jul. 2, 1991 to Butrus T. Khuri-Yakub et al., and assigned to the present assignee. In that patent application, an acoustic ink printhead has a pool of liquid ink having a free surface and intimate contact with the inner face of a perforated membrane. The perforations form large diameter apertures which are aligned with respective focused acoustic ejectors. Surface tension causes the ink menisci to extend across each of the apertures at substantially the same level. During an operation an essentially constant biased pressure is applied to the ink to maintain the menisci at a predetermined level.

However, some problems with the membrane perforation technique are difficulties associated with the misalignment of the apertures in the membrane with the acoustic ejectors, warpage of the membrane from an ideal flat surface, and variations in the distances between each aperture and corresponding ejector. Additionally, the edges of the perforations may sometimes be ragged, which can disturb the free surface of the ink so that the uniformity and quality of the ejected droplets are not consistent. Therefore alternate approaches for controlling the ink levels of the free surface for the ejectors are desirable.

The present invention provides for such an alternate approach.

SUMMARY OF THE INVENTION

The present invention provides for an integrated acoustic ink printhead with liquid level control. The acoustic printhead has a substrate with an array of ejectors. Each ejector has a substrate surface area capable of radiating a free surface (i.e., the liquid/air interface) of ink with focused acoustic radiation to eject individual droplets of ink on demand, and the acoustic focal length of each ejector is approximately equal to the acoustic focal lengths of other ejectors. A plurality of channels in the substrate communicate with said substrate surface areas of said ejectors to supply ink thereto.

Fixed to the substrate is a spacer layer with a first surface in contact with the substrate and a second surface opposite the first surface. The spacer layer has a predetermined thickness approximately equal to the difference between the ejector acoustic focal length and the radius of the acoustic lens. The spacer layer also has a first set of apertures through the spacer layer, each first set aperture self-aligned with one of the ejector substrate surface areas, and a second set of apertures through said spacer layer, each second set aperture aligned with one of the substrate ink supply channels.

Thus the first set of apertures in the spacer layer form a control for the level of the free ink surface above each ejector substrate surface.

The method of fabricating the integrated acoustic printhead comprises placing the spacer layer in fixed contact with the substrate. First and second sets of apertures are formed through the spacer layer. The first set of apertures is placed in locations corresponding to the locations of the ejectors on the substrate surface. The location of the second set of apertures corresponds to the location of ink supply channels for the ejectors. The ejectors and the ink supply channels are etched in the substrate with the spacer layer and the apertures used as a mask. Thus the apertures are self-aligned with the ejectors.

The first set of apertures in the spacer layer form a control for the level of the ink above the ejector substrate surface.

BRIEF DESCRIPTION OF THE DRAWINGS

A clear understanding of the present invention may be achieved by perusing the following detailed Description of Specific Embodiments with reference to the following drawings.

DESCRIPTION OF THE SPECIFIC EMBODIMENT(S)

Figure 1:
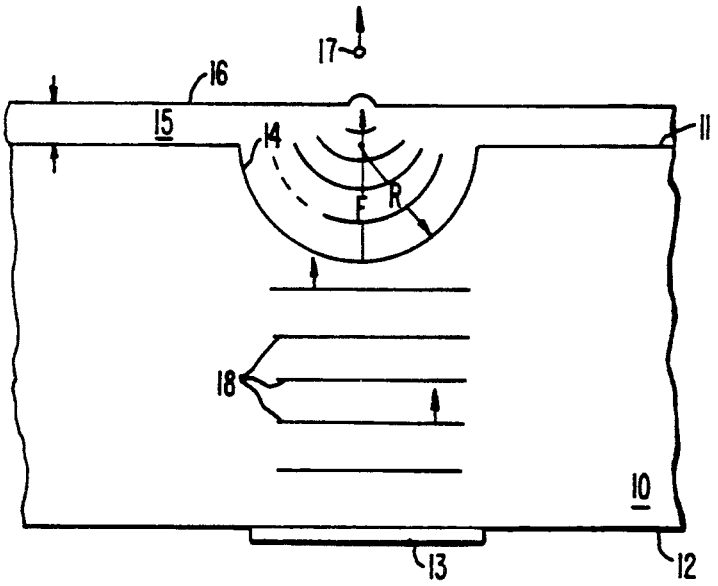
FIG. 1. PRIOR ART
FIG. 1 is a cross-sectional view of an acoustic ink ejector found in the prior art.

FIG. 1 shows an ejector of a printhead for an acoustic ink printer. In all the drawings, including FIG. 1, only a single ejector is shown. Typically the ejector is part of a closely spaced array, either linear or two-dimensional, in a substrate. During the printing operation, a recording medium, such as paper, is moved relative to and above the ejector array.

It should be noted that the drawings are not necessarily drawn to scale but to facilitate an understanding of the present invention.

The ejector is formed by part of a substrate 10, a concave surface 14 on the top surface 11 of the substrate 10 and a piezoelectric transducer 13 attached to the back surface 12 of the substrate 10. The spherically concave surface 14 is the microlens described in U.S. Pat. No. 4,751,529 mentioned above. The surface 14 has a radius of curvature R centered about a point on the top surface 11 of the substrate 10.

The ejector is covered by a pool of liquid ink 15 with a free surface 16. Under the influence of electric pulses the piezoelectric transducer 13 generates planar acoustic waves 18 which travel in the substrate 10 toward the top surface 11. The waves 18 have a much higher acoustic velocity in the substrate 10 than in the ink 15. Typically, the ink 15 has an acoustic velocity of about 1 to 2 kilometers per second, while the substrate 10 has a velocity of 2.5 to 4 times the acoustic ink velocity. When the waves 18 reach the substrate top surface 11, they are focused at or near the free ink surface 16 by the concave surface 14. The acoustic waves 18 are concentrated as they travel through the ink 15. If sufficiently intense, the focused acoustic energy can drive a droplet of ink 17 from the surface 16 to impact a recording medium (not shown) to complete the printing process.

As described above, it is important that the level of the free surface be maintained in proper position so that the acoustic waves are focused on the surface. Otherwise, the acoustic energy is not efficiently utilized, the uniformity and velocity of the ejected droplets become varied and the print quality deteriorates.

The present invention provides for an acoustic ink printhead in which the acoustic lens and liquid level control layer of each ejector are integrated and precisely positioned. Control of the free surface level is provided by a spacer layer which is fixed to the substrate according to the present invention. Aligned with the ejectors in the substrate, apertures in the spacer layer provide a space for a pool of ink for each ejector. Capillary action of the ink meniscus, the free surface, causes the free surface to maintain itself at the top surface of the spacer layer. While the apertures are small enough to maintain the level of the ink surface by capillary action, the apertures are large enough so that the focused waist diameters of the acoustic waves from the aligned ejectors below are substantially smaller than the diameters of the apertures. The apertures have no material effect upon the size or velocity of the ejected droplets.

Figure 2:
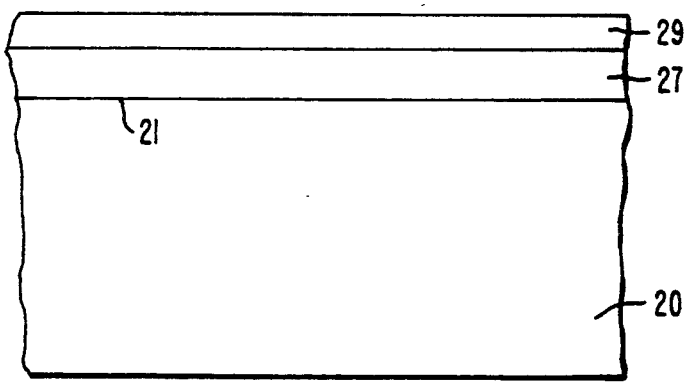
FIGS. 2–8 show the steps in manufacturing an ejector according to the present invention in an acoustic ink printhead.

FIG. 2–8 illustrates the steps of making such an integrated acoustic printhead. FIG. 2 shows a substrate 21 which may be made of silicon, alumina, sapphire, fused quartz and certain glasses. The upper surface 21 of the substrate 20 is covered by a spacer layer 27 of any suitable material, such as silicon, amorphous silicon or glass, but which is different then that of the substrate 20. The spacer layer 27 may be placed on the substrate surface 21 by any conventional technique, such as thin film deposition, epitaxial growth, plating or anodic bonding techniques.

The spacer layer 27 has a thickness H with $$H=R[1/(1-V_{ink}/V_{subs})-1]$$

where R, typically 150 microns, is the radius of the spherically concave lens and $V_{ink}$ and $V_{subs}$ are the acoustic velocities in ink and substrate respectively. The thickness H, typically 35 microns, of the spacer layer 27 is such that the acoustic waves are focused H distance from the top surface 21 of the substrate 20. Stated differently, the thickness of the spacer layer 27 is such the distance from acoustic lens to the top of said spacer layer is approximately equal to the acoustic focal length of the lens. During operation of the acoustic printhead, the free surface of the ink is maintained at the top of spacer layer 27.

Figure 3A:
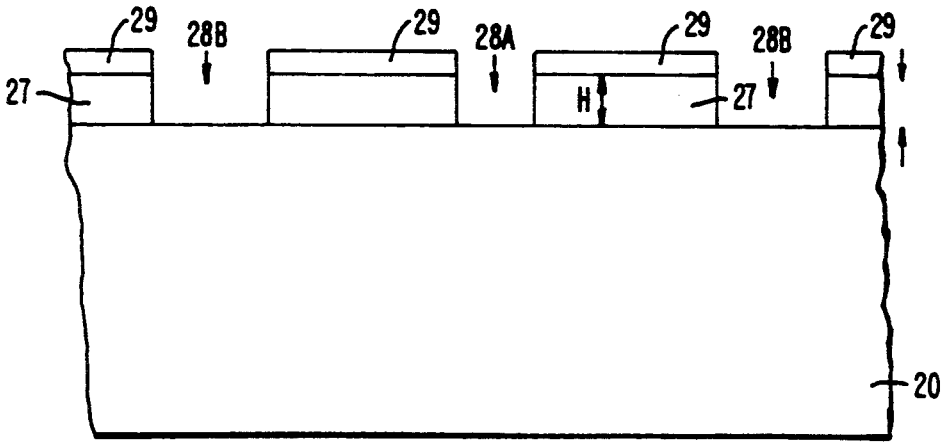

To define features in the spacer layer 27 and the underlying substrate 20, a photoresist layer 29 is deposited over the spacer layer 27. By standard photolithographic techniques, apertures are defined in the spacer layer 27 as illustrated in FIG. 3A. Initial aperture 28A, in the shape of circle, is used for the etching of the acoustic lenses in the substrate 20. Because the acoustic lens of each substrate is ideally a spherically concave surface, the aperture 28A should be small so as to appear as a point source for an isotropic etch through the aperture 28A into the substrate 20. However, the initial aperture 28A cannot be so small that the aperture interferes with the movement of etchant and etched material through the aperture 28A. Thus the initial diameter of the aperture 28A should be approximately 75 microns, about 25% of the final diameter of the aperture 38.

Apertures 28B are the etching aperture masks for the ink supply channels in the substrate 20.

Figure 3B:
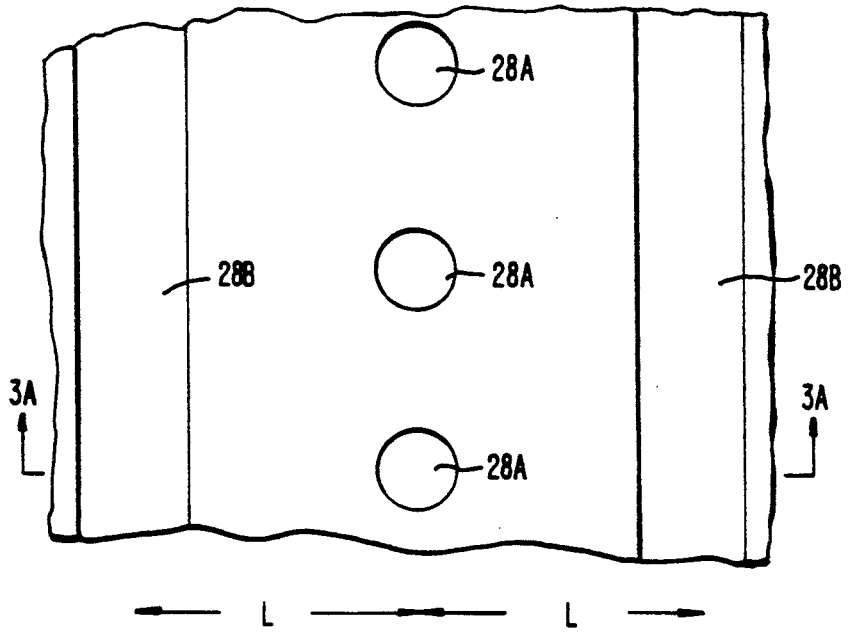

FIG. 3B is a top view of this stage of the manufacture. As can be seen from the drawing, each circular aperture 28A is part of a linear array with the parallel apertures 28B for the ink supply channels for the ejectors in the printhead. The apertures 28B for the ink supply channels are spaced 2L apart with the apertures 28A centered between. The parameter L, approximately 250 microns, is chosen such that upon the completion of the etching for the ink supply channels and acoustic lenses in the substrate 20, the ink supply channels and acoustic lenses are connected.

Figure 4:
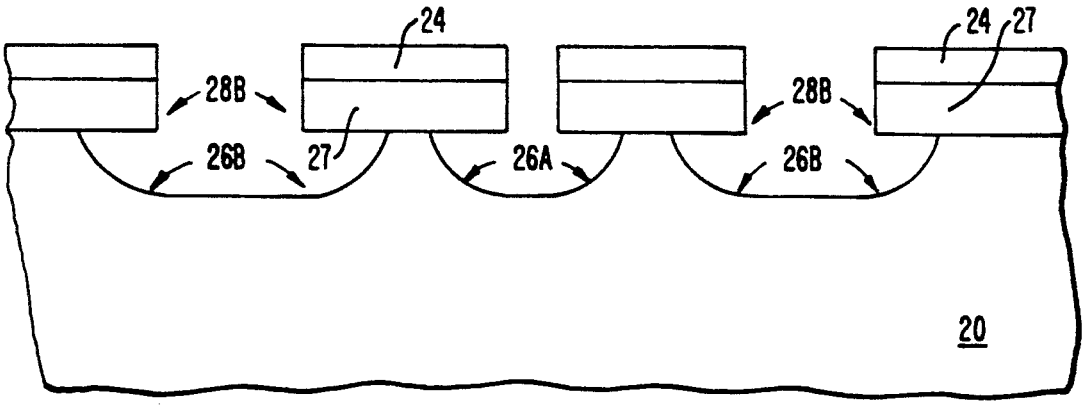

The substrate 20 is isotropically etched with the spacer layer 27 and photoresist layer 29 used as masks in the etching operation. FIG. 4 illustrates the beginnings of cavities 26A and 26B in the substrate 20. The cavity 26A is the start of the concave-surfaced microlens of the ejector. The cavities 26B form the beginnings of the cylindrically-shaped bottoms of the ink supply channels which interconnect the ejectors of the completed printhead.

Figure 5:
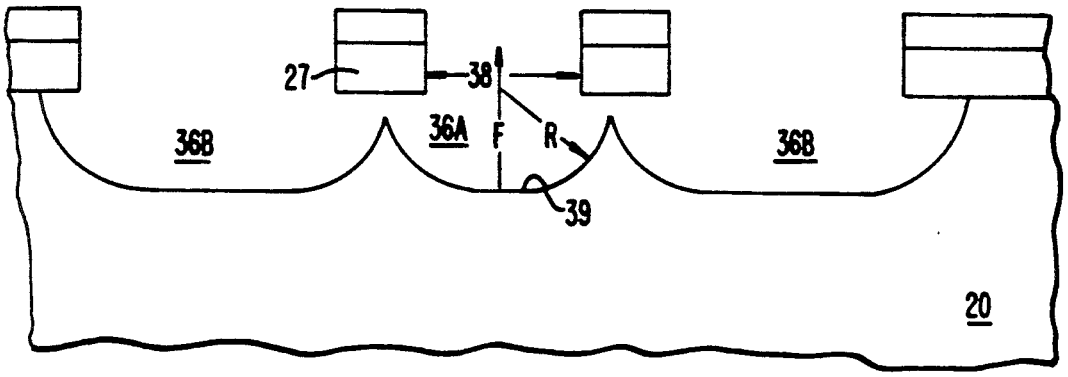

The results of the etching operation is shown in FIG. 5. The ink supply channels, the cavities 36B, are now in communication with the ink reservoir, the cavity 36A, above the spherically concave surface 39 (with radius of curvature R) of the ejector microlens (with acoustic focal length F). A second etching operation with a new photoresist layer 41 using an etchant which specifically removes the exposed spacer material and not the material of the substrate 20 is then performed. The operation opens the initial aperture 28A in the spacer layer 27 to the final aperture 38 and its full size of 0.1 mm in diameter. Such an etching operation again relies on the fact that the material of the substrate 20 is different from the material of the spacer layer 27 so that only the spacer layer 27 material is removed, as shown in FIG. 5.

Thus the final aperture 38 in the spacer layer 27 is self-aligned with the microlens, the concave surface 39 in the substrate 20.

Figure 6:
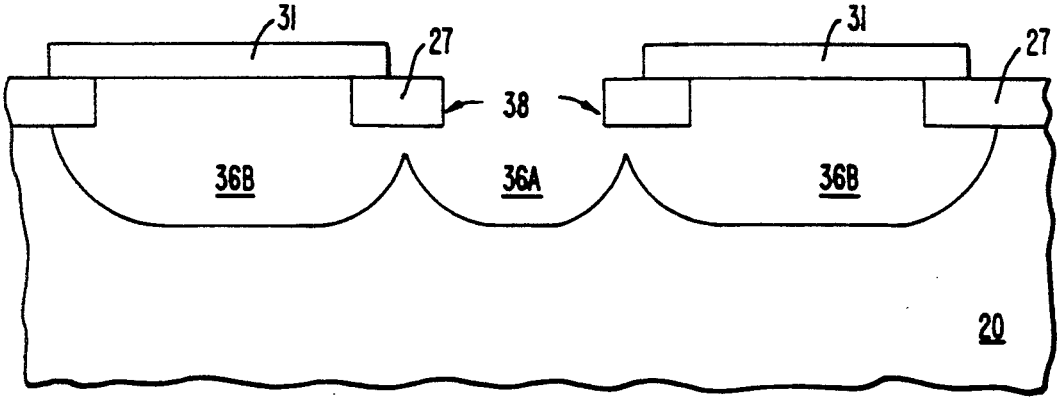

The photoresist layer 29 is then removed and as illustrated in FIG. 6, a sealing layer 31 is deposited over the substrate 20 and spacer layer 27. With another masking and etching operation, all of the material of the layer 31 is removed except that covering the apertures 28B. Thus, the ink supply channels are sealed. Typically, this layer 31 is formed by bonding a thin plate to the spacer layer 27, then etching away the undesired portion. Alternatively, the thin plate may be etched first and then bonded to the spacer layer 27. This is possible since the alignment between the plate and the spacer layer 27 is not particularly critical.

If desired, an optional layer 30 may then deposited over the substrate 20, the spacer layer 27 and the sealing layer 31. This material, which can be silicon nitride, silicon dioxide or other materials, is deposited by conventional techniques, such as sputtering, evaporation and chemical vapor deposition. The material should be different from the material of the spacer layer 27. Ideally the optional layer 30 should be more hydrophobic than the spacer layer 27. Note the word "hydrophobic" is used here with the presumption that the ink is water-based. "Hydrophobic" also includes the meaning of ink-repellant in the more general sense.

The optional layer 30 keeps the ink surface at the top surface height of the spacer layer 27. The hydrophobic optional layer 30 helps keep the top of the layer 30 from becoming wet and thereby drawing the ink surface up to a new level and out of focus of the acoustic beam.

Figure 7:
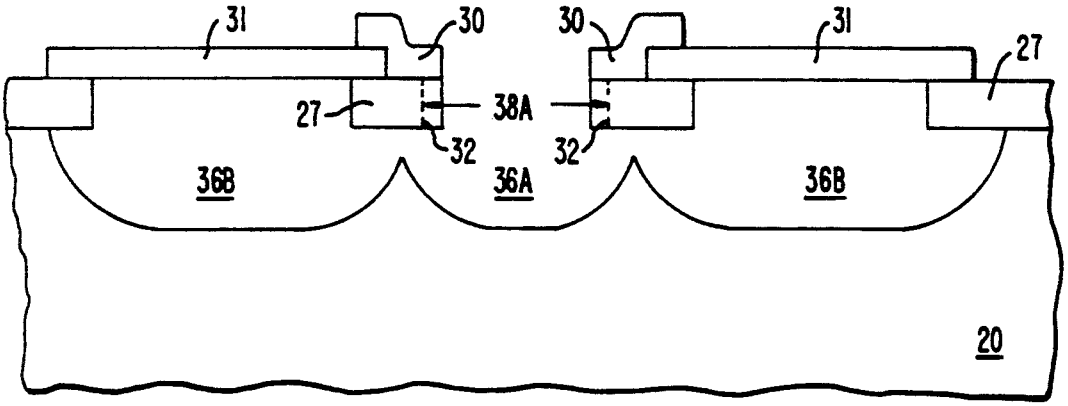

To help maintain the ink surface at this level, the spacer layer 27 may be cut back as shown by the dotted lines 32 in FIG. 7 by an etchant specific to the spacer layer material.

Figure 8:
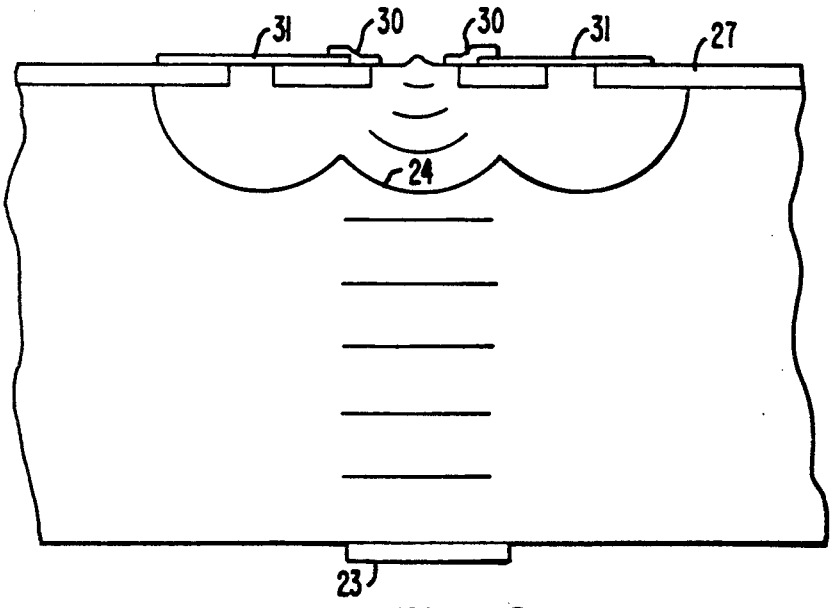

The ejector is completed by attaching a piezoelectric transducer on the bottom surface of the substrate 20. Of course, the piezoelectric transducer is aligned with the ejector cavity 26A and aperture 28A. FIG. 8 is a side view of the completed ejector which is more true to scale.

While the above is a complete description of the preferred embodiments of the invention, various alternatives, modifications and equivalents may be used. For example, with appropriate changes some of the fabrication steps may be reversed in order. Furthermore, exemplary dimensions and parameters have been disclosed, but other dimensions and parameters may be used for particular operational characteristics as desired. Therefore, the above description should not be taken as limiting the scope of the invention which is defined by the appended claims.

What is claimed is:

1. An integrated acoustic ink printhead with liquid level control comprising a substrate having an array of ejectors, each ejector having a concave substrate surface area with a radius of curvature capable of radiating a free surface of ink with focused acoustic radiation to eject individual droplets of ink on demand, said ejectors having approximately equal acoustic focal lengths; and a spacer layer with a first surface in intimate contact with said substrate and a second surface opposite said first surface, said spacer layer having a predetermined thickness approximately equal to a difference between said ejectro acoustic focal length and said ejector radius of curvature, said spacer layer also having a set of apertures through said spacer layer, each aperture aligned with one of said ejectors substrate surface area;

whereby said set of apertures in said spacer layer form a control for the level of said free ink surface above each ejector substrate surface.

2. The integrated acoustic printhead of claim 1 wherein said spacer layer has edges around said apertures, and further comprising a layer of hydrophobic material on said spacer layer extending around said edges around said apertures.

3. The integrated acoustic printhead of claim 2 wherein said layer of hydrophobic material has a higher degree of hydrophobicity than said spacer layer.

4. The integrated acoustic printhead of claim 3 wherein said layer of hydrophobic material extends around and over said edges of said apertures.

5. The integrated acoustic printhead as in claim 1 wherein said substrate surface area for each ejector is spherically concave with substantially a radius of curvature R and wherein said spacer layer has a thickness H, where $$[H=R[1/(1-V_{ink}/V_{subs})-1]]$$

$$H=R(1/(1-V_{ink}/V_{subs})-1)$$

and $V_{ink}$ and $V_{subs}$ are acoustic velocities in said ink and substrate respectively.

6. An integrated acoustic ink printhead with liquid level control comprising a substrate having an array of ejectors, each ejector having a concave substrate surface area with a radius of curvature capable of radiating a free surface of ink with focused acoustic radiation to eject individual droplets of ink on demand, each ejector having an acoustic focal length approximately equal to the acoustic focal lengths of other ejectors, said substrate also having a plurality of ink supply channels communicating with substrate surface areas of said ejectors to supply ink thereto; and a spacer layer with a first surface in intimate contact with said substrate and a second surface opposite said first surface, said spacer layer having a predetermined thickness approximately equal to a difference between said ejector acoustic focal length and said ejector radius of curvature, said spacer layer also having a first set of apertures through said spacer layer, each one of said first set of apertures aligned with one of said ejectors substrate surface area, and said spacer layer also having a second set of apertures through said spacer layer, each one of said second set of apertures aligned with one of said ink supply channels;

whereby said first set of apertures in said spacer layer form a control for the level of said free ink surface above each ejector substrate surface area.

7. The integrated acoustic printhead of claim 6 further comprising a covering layer over said second set of apertures whereby said ink supply channels are sealed.

8. The integrated acoustic printhead of claim 7 wherein said spacer layer has edges around said first set apertures, and further comprising a layer of hydrophobic material on said spacer layer extending around said edges around said first set apertures.

9. The integrated acoustic printhead of claim 8 wherein said layer of hydrophobic material has a higher degree of hydrophobicity than said spacer layer.

10. The integrated acoustic printhead of claim 9 wherein said layer of hydrophobic material extends around and over said edges of said first set of apertures.

11. The integrated acoustic printhead as in claim 6 wherein said substrate surface area for each ejector is spherically concave with substantially a radius of curvature R and wherein said spacer layer has a thickness H, where $$[H=R[1/(1-V_{ink}/V_{subs})-1]]$$

$$H=R(1/1-V_{ink}/V_{subs})-1)$$

where $V_{ink}$ and $V_{subs}$ are acoustic velocities in said ink and substrate respectively.

* * * * *